United States Patent [19]

Winslow

[11] Patent Number: 4,977,070

[45] Date of Patent: Dec. 11, 1990

[54] TRANSPARENTIZABLE ANTIHALATION LAYERS

[75] Inventor: John M. Winslow, South St. Paul, Minn.

[73] Assignee: Minnesota Mining and Manufacturing Company, St. Paul, Minn.

[21] Appl. No.: 865,110

[22] Filed: May 20, 1986

[51] Int. Cl.[5] ..... G03C 1/825

[52] U.S. Cl. ..... 430/510; 430/151; 430/152; 430/512; 430/513; 430/522; 430/290

[58] Field of Search ..... 430/510, 512, 522, 290, 430/152, 151, 513

[56] References Cited

U.S. PATENT DOCUMENTS

| | | | |
|---|---|---|---|
| 2,961,334 | 11/1960 | Clancy et al. | 117/36 |
| 3,269,835 | 8/1966 | Flint | 430/152 |
| 3,272,629 | 9/1966 | Hills | 430/151 |
| 3,298,833 | 1/1967 | Gaynor | 430/290 |
| 3,466,172 | 9/1969 | Skarvinko | 96/49 |
| 3,619,194 | 11/1971 | Mitchell | 430/510 |
| 3,977,875 | 8/1976 | Schumacher | 430/290 |
| 3,984,248 | 10/1976 | Sturmer | 430/522 |
| 4,206,980 | 6/1980 | Krueger et al. | 350/359 |
| 4,362,806 | 12/1982 | Whitmore | 430/202 |
| 4,387,154 | 6/1983 | Whitmore | 430/202 |
| 4,409,316 | 10/1983 | Zeller-Pendrey et al. | 430/513 |
| 4,436,213 | 3/1984 | Paul, Jr. et al. | 215/365 |
| 4,539,256 | 9/1985 | Shipman | 428/315.5 |
| 4,581,323 | 4/1986 | Fisher et al. | 430/510 |

FOREIGN PATENT DOCUMENTS

| | | | |
|---|---|---|---|
| 984237 | 2/1976 | Canada | 117/88.5 |

*Primary Examiner*—Charles L. Bowers, Jr.

*Attorney, Agent, or Firm*—Donald M. Sell; Walter N. Kirn; Mark A. Litman

[57] ABSTRACT

Support layers for photosensitive media comprise reflective sheeting which is transparentizable. The properties of the support layer enable it to act as an antihalation layer.

20 Claims, No Drawings

TRANSPARENTIZABLE ANTIHALATION LAYERS

BACKGROUND OF THE INVENTION

1. Technical Field

This invention relates to imaging media having at least one antihalation layer associated therewith. The antihalation layer is translucent and is rendered transparent by the application of heat and/or pressure 2. Background Art There are many potentially adverse phenomena which can occur during the imaging and development of photosensitive media. One of these adverse phenomena is named halation. The source of this problem has been long recognized as the reflection of light from the back of the photosensitive media. The reflected light is diffuse, and when high intensity radiation is used in the exposure step, a sharp halo of light is produced which generates an undesirable image in the media Many types of radiation absorbing layers have been placed on photosensitive media to absorb the radiation before it is reflected These radiation absorbing layers are termed antihalation layers.

One problem with the use of antihalation layers is that in order for them to absorb radiation to which the photosensitive media is sensitive, the layers must often absorb visible radiation. This renders the antihalation layers visible and the layers can interfere with the viewability of the desired image. It is therefore an essential characteristic of most antihalation layers that any visible characteristics of the antihalation layer are removable at some point after exposure, usually during or after image development.

In silver halide photographic materials, aqueous alkaline soluble antihalation layers containing carbon black are used on the backside of the photographic media. These antihalation layers are dissolved and removed during development of the photographic media. Such antihalation layers are shown in U.S. Pat. Nos. 2,271,234; 3,392,022; 4,039,333 and 4,262,088.

Vesicular imaging films and diazo imaging films are also known to utilize antihalation layers as reported in U.S. Pat. No. 3,466,172. Here, an antihalation layer of actinic radiation absorbing diazo compounds is deactivated by post-exposure of the antihalation layer to actinic radiation.

The use of bleachable dye-containing layers as antihalation layers is also known in the art. The dyes may be chemically bleachable (e.g., U.S. Pat. Nos. 3,769,019 and 4,336,323) or heat bleachable (e.g., U.S. Pat. Nos 4,196,002 and 4,316,984).

Other antihalation layers have been described which are physically stripped from the imageable material after image development (e.g., U.S. Pat. No. 4,262,088).

Each of these systems provide improved halation characteristics to the imaging media, but also provide some attendant problems Antihalation layers which are removed in development baths tend to foul up the baths with binders and pigments. It is often difficult to find dyes which are both bleachable and absorptive at the desired wavelengths. Bleachable dyes tend to leave color residues or stains in the image. It is therefore desirable to find antihalation layers which have a broad range of spectral absorptivity and which are readily converted to a lower radiation absorptive activity after imaging.

SUMMARY OF THE INVENTION

An antihalation layer for use with imaging media comprises an at least translucent film with an optical density to white light of at least 0.2, which film can be rendered transparent by heating at a temperature of no less than 100° C. The antihalation layer, if on an exposed surface of the imaging material can sometimes be rendered transparent by an abrasive pressure on the layer.

DETAILED DESCRIPTION OF THE INVENTION

Imaging media of various types can benefit from the use of the antihalation medium of the present invention. Photographic media (including black-and-white film and print; color photographic film, print, and negatives; diffusion transfer media; and radiographic media), photothermographic media (including dry silver media as described in U.S. Pat. No. 3,457,075 and vesicular media), diazonium salt and diazo oxide media, photopolymeric media, lithographic print and prepress color proofing media, laser scanned media and the like can benefit from the presently described antihalation layers. High intensity imaging processes such as those using lasers as the imaging source can particularly benefit from the practice of the present invention. The photosensitive media can be sensitive to various portions of the electromagnetic spectrum. Preferably the media are sensitive to the ultraviolet, the visible and/or the infrared. Most preferably the media are sensitive to the visible (e.g., 410 to 780 nm) or the infrared (e.g., 780 to 1000 nm).

The antihalation layer of the present invention can be placed in any of the various locations within the imaging media where antihalation layers have been used. Traditionally the antihalation layers have been placed on the exposed backside of any supporting layers, or between the support layer and the radiation sensitive layer. The antihalation layer can also be placed between radiation sensitive layers if the properties of the transparentizable antihalation layer is controlled so that it is not absorptive of the radiation to which one of the layers is spectrally sensitized. If the imaging media is a two-side coated photographic element for use in an X-ray cassette with intensifying screens, it is not necessary that the layer be transparent to the exposing radiation since that radiation will come from both sides of the imaging media. In fact, absorption of the radiation from the screens is desirable as cross-over effects are reduced or eliminated. "Transparentizable" as used in the practice of the present invention means that the transmission optical density of the antihalation layer can be reduced by at least 0.2 or 40% (whichever is lesser) by the application of chemically inert processing. By chemically inert processing is meant process steps which do not introduce active chemistry into the antihalation layer and which does not alter or activate chemistry already within the layer to react with other ingredients. Bleaching of dyes by heat would clearly be an alteration of chemistry already within the layer. The term optically connected means that most (e.g, at least 50%) radiation which has already passed through light sensitive layers is not prevented from striking the antihalation layer.

The compositions and structures of the layers which can be used as antihalation layers in the practice of the present invention are known in the art. U.S. Pat. No. 4,539,256 discloses a microporous material which is opaque to translucent (depending upon the degree of stretching and relaxation) and which can be rendered transparent by heating (e.g., 170° C. for 5 seconds) or by abrasive pressure (e.g., 750 g/cm$^2$ with an edged element such as a fingernail or scraping device). These films can be described generically as microporous (e.g, pores between 0.1 and 50 microns, preferably between 0.2 and 25 microns) polymeric film having an internal structure characterized by a multiplicity of spaced, randomly dispersed, non-uniform shaped particles, fibrils, fibers, or filaments. Preferably these particles are equioxed and coated with a compound miscible with the polymer. The polymer film may generally be referred to as reticulated. It is the internal microporous structure of the film which provides optical density to the film. Other opacifiers (e.g., dyes, pigments) may be present, but the internal structure of the film must provide transmission optical density of at least 0.3. U.S. Pat. No. 4,206,980 shows a material, which when stretched to translucency (as disclosed therein) can be transparentized by heat relaxation. Another available layer comprises a film having a reasonable uniform distribution of vesicles therein The film should be thermally activatable to allow the collapse of the vesicles or escape of the trapped gas from within the vesicles. Such films can readily be made by complete surface exposure and development of commercially available vesicular imaging media. After such surface exposure and development, the sheet is opaque because of the presence of the light scattering effect of the vesicles These vesicles may then be destroyed by heat and/or pressure.

Typical vesicular films useful in the present invention are fully exposed and hardened vesicular film. that is, the light sensitive vesicular film is exposed across the entire area that is to be used as an antihalation layer, heated to expand the vesicles, and then cooled to harden the vesicles. This process forms an optically dense sheet (i.e., projected optical density in excess of 0.5) having vesicles or bubbles therein having average diameters of between 0.2 and 25 microns. Preferably the bubbles will have an average diameter of between 0.5 and 15 microns and most preferably between 0.75 and 12 microns. The application of pressure and/or heat can readily collapse the vesicles rendering the sheet transparent to translucent.

Minimum transmission optical densities for the antihalation layers of the present invention should be at least 0.3. Preferably, the minimum optical density (to white light) should be at least 0.5, more preferably at least 1.0 and most preferably at least 2.0. These optical densities can be measured in commercially available densitometers. ANSI Standard pH 2.36-1974 can also be consulted for back9round on measurements of optical densities.

Pressure sensitivity of the antihalation layers can be measured on conventional two inch (5.08 cm) diameter steel nip rollers as used for testing the calendaring of paper. For the most useful range of pressure clarifying properties, the antihalation layer, either alone or on the imaging element, should decrease its optical density by at least 0.2 when subjected to between 50 and 500 kg per linear centimeter in 5 cm diameter nip rollers. Preferably the antihalation layer will decrease its optical density by at least 0.5 more preferably at least 1.0 and most preferably at least 2.0 when subjected to between 50 and 500 kg per linear centimeter pressure in 5 cm diameter steel nip rollers.

The antihalation layer may also transparentize when subjected to heat alone (e.g., in an oil bath, steam bath, air oven, or infrared heating). The layer should not lose more than 30% of its optical density when stored for 1 hour at 100° F. (38° C.). Preferably, at a temperature between 40° and 250° C. (with a dwell time of 1 minute) the layer will lose at least 50% of its optical transmission density. More preferably it will have its transmission optical density decrease by at least 0.3 units, more preferably by at least 1.0 units, and most preferably by at least 2.0 units when heated between 40° and 250° C. for 1 minute.

The antihalation layer of the present invention has been found to significantly reduce glare (lots of sharpness at the edges of the image) in a low cost and effective manner. The speed of imaging systems used in combination with the antihalation layers of the present invention have also been increased, solely by the presence of the antihalation layer.

The antihalation layer of the present invention has been referred to as transparentizable by chemically inert processing. Additional antihalation technology already known and practiced in the act may be combined with the present invention. For example, the reticulated polyolefin materials may have a heat bleachable dye in a binder solution which is imbibed into its pores. Upon heating, both the pores would collapse and the dyes would bleach. As long as at least 0.2 or 40% of the transmission optical density loss to white light is attributable to collapse of cells or vesicles, the benefits of the present invention are being achieved.

EXAMPLE 1

A transparentizable film was manufactured as follows.

Crystallizable polypropylene (available under the trade designation "Profax" type 6723 from Hercules, Inc.) having a density of 0.903 g/cc, a melt flow index (ASTM D 1238, Condition I}of 0.8 and melting point of about 176° C. was introduced into the hopper of a 2.5 cm extruder fitted with a 10.16 cm by 0.076 cm slit gap sheeting die positioned above a water quench tank. The polypropylene was fed into the extruder and the extruder operated at a 60 cc/min throughput rate to produce a polypropylene sheet collected at the rate of 7.6 meters per minute. Mineral oil (available under the trade designation "Nujol" from Plough, Inc.) having a boiling point of 200° C. and a standard Saybolt viscosity of 360–390 at 38° C. (about 80 centistokes) was introduced into the extruder through an injection port at a rate to provide a blend of 70% by weight polypropylene and 30% by weight mineral oil. The mixture was cast as a transparent film into the water quench bath which maintained at 49° C., producing a quenched film at the rate of 7.6 meters per minute. The melt in the extruder and the sheet die was maintained at approximately 245° C. during extrusion. The resulting film was then oriented at room temperature in the machine direction to obtain 35 degrees of elongation.

This film was adhered to a three mil ($7.6\times10^{-4}$ m) polyethyleneterephthalate film base with a cellulose acetate butyrate adhesive. On top of the transparentizable film was coated a two-trip photothermographic imaging system as taught in Example 1, sample 2 of U.S. Pat. No. 4,123,282. The dried sample was exposed through a continuous wedge to a tungsten light source. Thermal development at 250° F. (for 12 seconds produced a sharp image free of halation and transparentized the antihalation layer.

EXAMPLES 2–4

Example 1 was repeated, using the transparentizable film of Examples 8, 14 and 15 of U.S. Pat. No. 4,539,256. Higher post-development temperatures were necessary with the polyester and nylon transparentizable film in order to render them optically clear.

EXAMPLE 5

A sheet of commercially available vesicular microfilm-quality film was fully exposed to ultraviolet radiation, then heated and cooled to form an optically dense film. The exposed and hardened film displayed an optical transmission density of about 2.5 to white light A photothermographic element as taught in the first Example, sample 7, of U.S. Pat. No. 4,123,282 was coated on the opposite side. The dried element was exposed through a continuous tone wedge to a tungsten light source. Thermal development was at 250° F. (121° C.) for twelve seconds. this was compared to the same photothermographic imaging system coated over primed polyester base. The data are shown below.

| | Dmin | Dmax | Speed Point to 1.5 O.D. |
|---|---|---|---|
| Polyester base | 0.19 | 3.18 | 1.35 |
| Vesicular base | 0.20 | 3.22 | 1.20 |

The speed of the emulsion was increased by 0.15 logE units on the antihalation layer of the present invention, and the flare of the image was easily seen to be reduced with the antihalation layer of the present invention.

EXAMPLES 6–10

Four samples of the opaque polyethylene sheeting of Example and one sample of the opaque vesicular film of Example 5 were run between 5.0 cm steel nip rollers and the pressure between the rolls set at various levels. The results are shown below.

| Pressure | Projected Density | | |
|---|---|---|---|
| (kg/in cm) | Dmax | Dmin | Sample |
| 60 | 2.56 | 0.38 | Polyethylene |
| 70 | 2.61 | 0.28 | Polyethylene |
| 85 | 2.52 | 0.22 | Polyethylene |
| 125 | 2.61 | 0.25 | Polyethylene |
| 125 | 1.49 | 0.79 | Vesicular |

These examples show that the antihalation layers of the present invention are transparentizable by pressure alone. The polyethylene as shown to be highly clarified by pressure alone, while the vesicular material is shown to be better used with heat, either alone or in combination with pressure.

I claim:

1. A photosensitive imageable article comprising at least two layers, at least one layer of which is a photosensitive imaging layer and at least one other layer optically connected to said at least one layer is an antihalation layer having a transmission optical density of at least 0.3, said antihalation layer being characterized by the fact that it comprises a polymeric material having opacifying means therein selected from the group consisting of voids, bubbles, vesicles, and cells, and by the fact that said antihalation layer is transparentizable by chemically inert processing, said antihalation layer comprising a support layer or there is a third layer present in said article which comprises a support layer.

2. The article of claim 1 wherein said antihalation layer comprises a polymer having voids therein.

3. The article of claim 1 wherein said antihalation layer comprises a polymer having vesicles therein.

4. The article of claim 1 wherein the antihalation layer has an optical density of at least 1.0.

5. The article of claim 2 wherein the antihalation layer has an optical density of at least 1.0.

6. The article of claim 5 wherein the antihalation layer has an optical density of at least 1.0.

7. The article of claim 1 wherein said antihalation layer is transparentizable by heating for less than 1 minute at a temperature between 40° and 250° C.

8. The article of claim 4 wherein said antihalation layer is transparentizable by heating for less than 1 minute at a temperature between 40° and 250° C.

9. The article of claim 5 wherein said antihalation layer is transparentizable by heating for less than 1 minute at a temperature between 40° and 250° C.

10. The article of claim 6 wherein said antihalation layer is transparentizable by heating for less than 1 minute at a temperature between 40° and 250° C.

11. The article of claim 1 wherein said antihalation layer is transparentizable by pressure from 5.0 cm diameter steel nip rollers at 50–500 kg/linear cm.

12. The article of claim 4 wherein said antihalation layer is transparentizable by pressure from 5.0 m diameter steel nip rollers at 50–500 kg/linear cm.

13. The article of claim 5 wherein said antihalation layer is transparentizable by pressure from 5.0 cm diameter steel nip rollers at 50–500 kg/linear cm.

14. The article of claim 6 wherein said antihalation layer is transparentizable by pressure from 5.0 cm diameter steel nip rollers at 50–500 kg/linear cm.

15. The article of claim 1 wherein said antihalation layer comprises a microporous polymer having a reticulated internal structure which provides a transmission optical density of at least 0.3.

16. The article of claim 2 wherein said antihalation layer comprises a microporous polymer having a reticulated internal structure which provides a transmission optical density of at least 0.3.

17. The article of claim 3 wherein said antihalation layer comprises a microporous polymer having a reticulated internal structure which provides a transmission optical density of at least 0.3.

18. The article of claim 10 wherein said antihalation layer comprises a microporous polymer having a reticulated internal structure which provides a transmission optical density of at least 0.3.

19. A photosensitive imageable article comprising at least three layers, at least one layer of which is a photosensitive imaging layer, a support layer, and at least one other layer optically connected to said imaging layer which is an antihalation layer having a transmission optical density of at least 3.0, said antihalation layer being characterized by the fact that is comprises a polymeric material having opacifying means therein selected from the group consisting of voids, bubbles, vesicles, and cells, and by the fact that said antihalation layer is transparentizable by chemically inert processing.

20. The article of claim 19 wherein at least three layers are present, two of said layers interacting to form an imageable material and being on the same side of said antihalation layer.

* * * * *

UNITED STATES PATENT AND TRADEMARK OFFICE

CERTIFICATE OF CORRECTION

PATENT NO. : 4,977,070

DATED : Dec. 11, 1990

INVENTOR(S) : Winslow

It is certified that error appears in the above-identified patent and that said Letters Patent is hereby corrected as shown below:

Col. 4, line 38, After Condition 1 replace "}" with --)--

Col. 6, line 57, Replace "3.0" with --0.3--

Signed and Sealed this

Sixteenth Day of November, 1993

*Attest:*

*Attesting Officer*

Bruce Lehman

BRUCE LEHMAN

*Commissioner of Patents and Trademarks*